US012528148B2

(12) United States Patent
Moen et al.

(10) Patent No.: US 12,528,148 B2
(45) Date of Patent: Jan. 20, 2026

(54) PLATEN APPARATUS AND TURBINE CONTACT WHEEL THEREOF FOR BELT GRINDERS

(71) Applicant: Moen Tooling LLC, Dallas, TX (US)

(72) Inventors: Jerry Michael Moen, Dallas, TX (US); Princeton Wong, Houston, TX (US)

(73) Assignee: Moen Tooling LLC, Dallas, TX (US)

( * ) Notice: Subject to any disclaimer, the term of this patent is extended or adjusted under 35 U.S.C. 154(b) by 537 days.

(21) Appl. No.: 18/050,570

(22) Filed: Oct. 28, 2022

(65) Prior Publication Data

US 2024/0139899 A1 May 2, 2024

(51) Int. Cl.
*B24B 21/14* (2006.01)
*B24B 21/20* (2006.01)

(52) U.S. Cl.
CPC ..... *B24B 21/14* (2013.01); *B24B 21/20* (2013.01)

(58) Field of Classification Search
CPC ..... B24B 21/002; B24B 21/006; B24B 21/02; B24B 21/04; B24B 21/06; B24B 21/08; B24B 21/10; B24B 21/16; B24B 21/14; B24B 21/20; B24B 23/06; B24B 55/057; B24B 55/02; B24B 3/36; B24B 3/52; B24B 3/54; F16H 57/0416; F16H 57/031; F16H 57/0412; F16H 57/0413; F16H 41/20; F16H 55/36; Y10T 74/2189; B25F 5/008
USPC ..... 474/93; 74/606 A
See application file for complete search history.

(56) References Cited

U.S. PATENT DOCUMENTS

| | | | | |
|---|---|---|---|---|
| 2,070,257 | A | 2/1937 | Coates | |
| 3,229,424 | A | 1/1966 | Fairchok | |
| 3,362,111 | A * | 1/1968 | Foell, Jr. | B24B 23/06 451/355 |
| 3,608,245 | A | 9/1971 | Brotherton et al. | |
| 3,686,798 | A | 8/1972 | Copresti | |
| 3,826,306 | A | 7/1974 | Marsh | |
| 3,983,664 | A | 10/1976 | Martin | |
| 4,662,121 | A | 5/1987 | Ginter | |
| 4,671,782 | A * | 6/1987 | Ochiai | F16H 57/0415 474/93 |
| 5,957,758 | A | 9/1999 | Shrum | |
| 2009/0258579 | A1 | 10/2009 | Joslin | |
| 2018/0311780 | A1 * | 11/2018 | Moen | B24B 21/08 |

FOREIGN PATENT DOCUMENTS

GB 687800 A 2/1953

* cited by examiner

*Primary Examiner* — Brian D Keller
*Assistant Examiner* — Sidney D Full
(74) *Attorney, Agent, or Firm* — Whitmyer IP Group LLC

(57) ABSTRACT

A platen apparatus includes a housing having multiple vents; a turbine wheel rotatably attached to a rear section of the housing, the wheel having a circular body and a circumferential face without a coating thereon, the body includes vanes, each vane being a hole which extends through the body from one side to an opposing side of the wheel; a support belt engaged in tension about the circumferential face of the wheel; and the rear section of the housing is at least partially open so that a portion of the circumferential face of the wheel is exposed outside the housing. The vanes are arranged adjacent to the vents, and each provide a flow channel through which air is drawn in from a first side of the housing through the wheel body and released at a second, opposite side of the housing.

19 Claims, 12 Drawing Sheets

Top View

Front View

Section B-B

PLATEN APPARATUS AND TURBINE CONTACT WHEEL THEREOF FOR BELT GRINDERS

TECHNICAL FIELD

The present teachings relate to grinding tools and sharpening tools. More specifically, the present teachings relate to a belt grinder and a support apparatus for the abrasive belt of the belt grinder.

BACKGROUND

A belt grinder is a machine for removing material quickly and for finishing surfaces. For example, the belt grinder can be used to grind, sharpen, and/or smooth corners, edges, trenches, and ditches of a rough or semi-finished workpiece.

A conventional belt grinder comprises at least a drive motor, a main drive wheel, a return wheel, and an abrasive belt which passes over the main drive wheel, return wheel, and tension roller. The return wheel has an external diameter in line with the outer diameter of the main drive wheel so that the grinding belt tracks along a straight-line section between the two wheels.

A platen can be mounted behind an open area of the belt, such as the straight-line section, to provide rigid support for the belt and to accommodate flat grinding onto the belt. The platen is in the form a flat metal plate. The drive wheel may be formed with a larger diameter wheel compared to the return wheel so that the belt may be configured with different dimensioned radii for grinding different curvatures. In addition to the platen, or alternatively, the belt grinder may include a contact wheel arranged behind the belt. The circumference of the contact wheel is covered with rubber, urethane, or another type of elastomer, which provides cushioned support for the belt. The depth or thickness of the elastomeric cushion (in a radial direction) determines how effective the belt grinds and what kind of finish will result.

However, conventional belt grinders suffer from heating issues. As the drive motor moves the abrasive belt around the wheels, heat is generated as a result of high friction. Heat buildup may arise due to excessive pressure applied on the abrasive belt and/or wheels during a grinding or finishing operation. Since the abrasive belt runs across the platen or contact wheel, the contact therebetween also generates a substantial amount of heat. The grind shavings of the workpiece themselves experience heating as well. These heating issues can adversely affect quality and characteristics of the workpiece (e.g., heat-treated metal, plastics) being worked on with the grinder. This is especially true in knife-making, where overheating can warp the shape of the blade and can affect the finish of the blade. Over-tempering can occur while honing the knife on the grinder. When grinding with too much heat, the blade edge will turn blue, which indicates that the edge has softened and will no longer stay sharp and resist wear. Deburring and honing at high rpm (rotations per minute) can heat the blade edge apex to over-tempering temperatures, thereby compromising the edge retention and rendering it prone to rolling. As a consequence, the over-heating negatively impacts the blade's heat treatment.

Thus, there exists a need for an improved belt grinder that overcomes the above heating issues. More specifically, there is a need for an improved platen apparatus and contact wheel that reduces heat generation and prevents—or at least minimizes—heat treatment loss in the workpiece being worked on with the belt grinder.

SUMMARY

The needs set forth herein as well as further and other needs and advantages are addressed by the present embodiments, which illustrate solutions and advantages described below.

It is an object of the present teachings to remedy the above drawbacks and shortcomings associated with known belt grinders and platen apparatuses.

It is an object of the present teachings to provide a contact wheel that has integrated cooling to hinder overheating. It is similarly an object of the present teachings to provide a belt-supporting apparatus or platen apparatus that includes such contact wheel with integrated cooling. Also, it is an object of the present teachings to provide a belt grinder having a belt-supporting apparatus or platen apparatus that includes such contact wheel with integrated cooling.

It is an object of the present teachings to provide a contact wheel that has a simple design for active cooling and regulation of heating.

It is another object of the present teachings to improve the cutting/grinding efficiency of abrasive belts and to suppress negative effects that overheating may have on a material being worked on with the grinder. This will not only reduce the time needed to complete a grinding or finishing operation, but also reduces the risk of ruining the workpiece and any treatment performed on the workpiece prior to the grinding or finishing step.

These and other objects of the present teachings are achieved by providing a platen apparatus which comprises a housing having a plurality of vents that provide fluid communication, a turbine wheel rotatably attached to a rear section of the housing, the wheel having a circular body and a circumferential face without a coating thereon, at least two pressure rollers rotatably attached to a front section of the housing so that rotation axes of the at least two pressure rollers are parallel to a rotation axis of the wheel, and a support belt engaged in tension about the at least two pressure rollers and a circumferential face of the wheel. The circular body of the wheel includes a plurality of vanes, each vane being a hole which extends through the circular body from one side of the wheel to an opposing side of the wheel. The housing only partially encloses the wheel so that a portion of the circumferential face of the wheel is exposed outside the housing. The vanes are arranged adjacent to the vents and each providing a flow channel through which air is drawn in from a first side of the housing through the circular body of the wheel and released at a second, opposite side of the housing.

The objects of the present teachings are also achieved by providing a platen apparatus which comprises a housing which includes two plates arranged parallel to each other, each plate having a plurality of vents that provide fluid communication, a turbine wheel rotatably attached to a rear section of the housing between the two plates, the wheel having a circular body and a circumferential face without a coating thereon, and a support belt engaged in tension about the circumferential face of the wheel. The circular body includes a plurality of spiral vanes, each vane being a hole which extends through the circular body from one side of the wheel to an opposing side of the wheel. The rear section of the housing is at least partially open so that a portion of the circumferential face of the wheel is exposed outside the housing. The vanes are arranged adjacent to the vents and each providing a flow channel through which air is drawn in from a first side of the housing through the circular body of the wheel and released at a second, opposite side of the housing.

The present teachings also provide a grinding tool system, which comprises a platen apparatus and a worktable releasably mounted to the platen apparatus. The platen apparatus includes a housing which includes two plates arranged parallel to each other, each plate having a plurality of vents that provide fluid communication, a turbine wheel rotatably attached to a rear section of the housing between the two plates, the wheel having a circular body and a circumferential face without a coating thereon, a support belt engaged in tension about the circumferential face of the wheel, and a slot positioned on an exterior side of one of the plates. The circular body includes a plurality of spiral vanes, each vane being a hole which extends through the circular body from one side of the wheel to an opposing side of the wheel. The rear section of the housing is at least partially open so that a portion of the circumferential face of the wheel is exposed outside the housing. The vanes are arranged adjacent to the vents and each providing a flow channel through which air is drawn in from a first side of the housing through the circular body of the wheel and released at a second, opposite side of the housing. The worktable has an arm, which is releasably mounted within the slot. The arm is pivotable relative to the worktable to adjust an angle between the worktable and the support belt.

Other features and aspects of the present teachings will become apparent from the following detailed description, taken in conjunction with the accompanying drawings, which illustrate by way of example the features in accordance with embodiments of the present teachings. The summary is not intended to limit the scope of the present teachings.

DETAILED DESCRIPTION

The present teachings are described more fully hereinafter with reference to the accompanying drawings, in which the present embodiments are shown. The following description is presented for illustrative purposes only, and the present teachings should not be limited to these embodiments.

The present teachings have been described in language more or less specific as to structural and mechanical features. It is to be understood, however, that the present teachings are not limited to the specific features shown and described, since the device, apparatus, and/or system herein disclosed comprises preferred forms of putting the present teachings into effect.

For purposes of explanation and not limitation, specific details are set forth such as particular structures, architectures, interfaces, techniques, etc. in order to provide a thorough understanding. In other instances, detailed descriptions of well-known devices and/or methods are omitted so as not to obscure the description with unnecessary detail.

Generally, all terms used in the claims are to be interpreted according to their ordinary meaning in the technical field, unless explicitly defined otherwise herein. All references to a/an/the element, apparatus, component, means, step, etc. are to be interpreted openly as referring to at least one instance of the element, apparatus, component, means, step, etc., unless explicitly stated otherwise. The use of "first", "second," etc. for different features/components of the present disclosure are only intended to distinguish the features/components from other similar features/components and not to impart any order or hierarchy to the features/components, unless explicitly stated otherwise.

Figure 1:
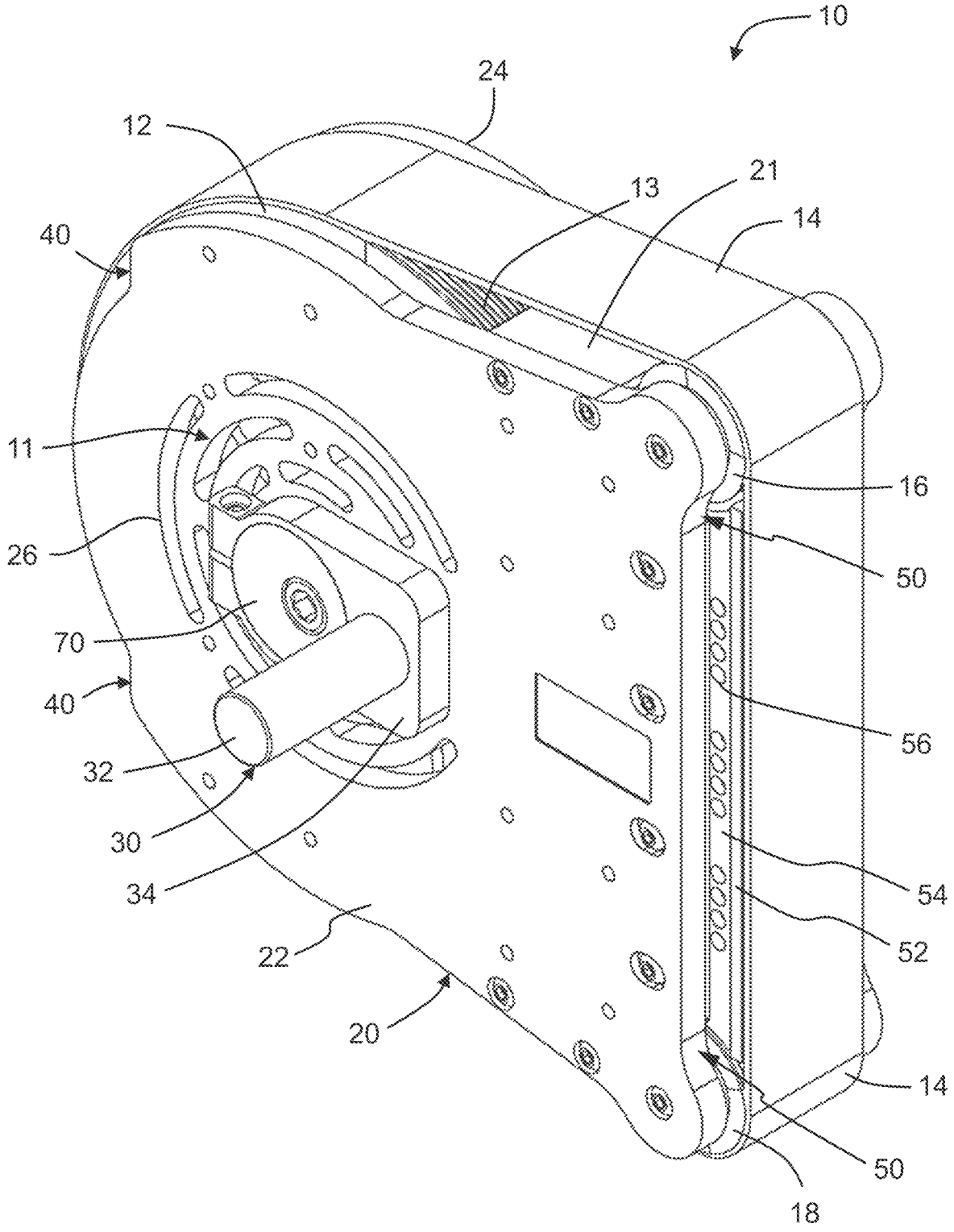
FIGS. 1-6 are different views of a platen apparatus according to the present teachings.
Figure 2:
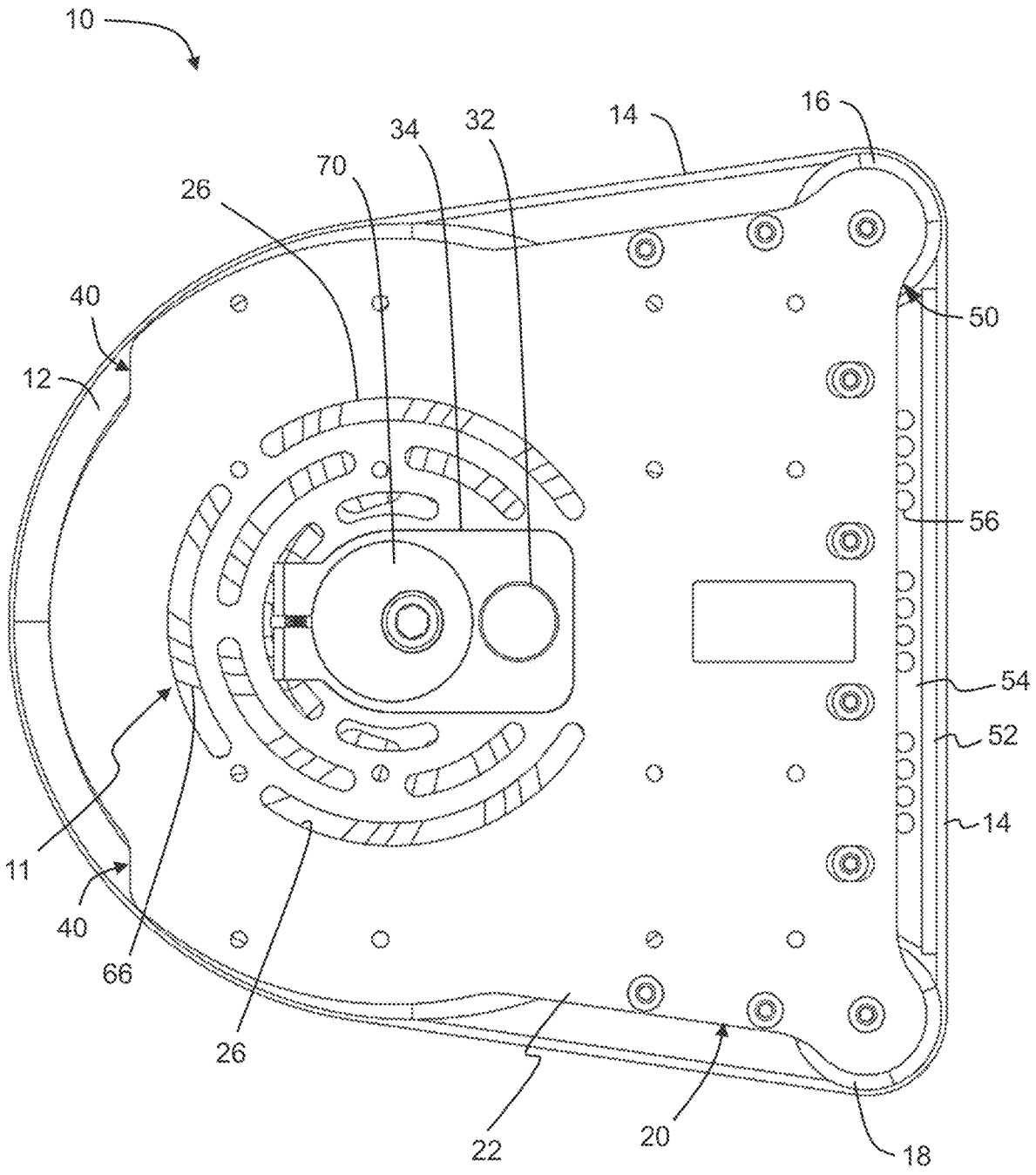
Figure 3:
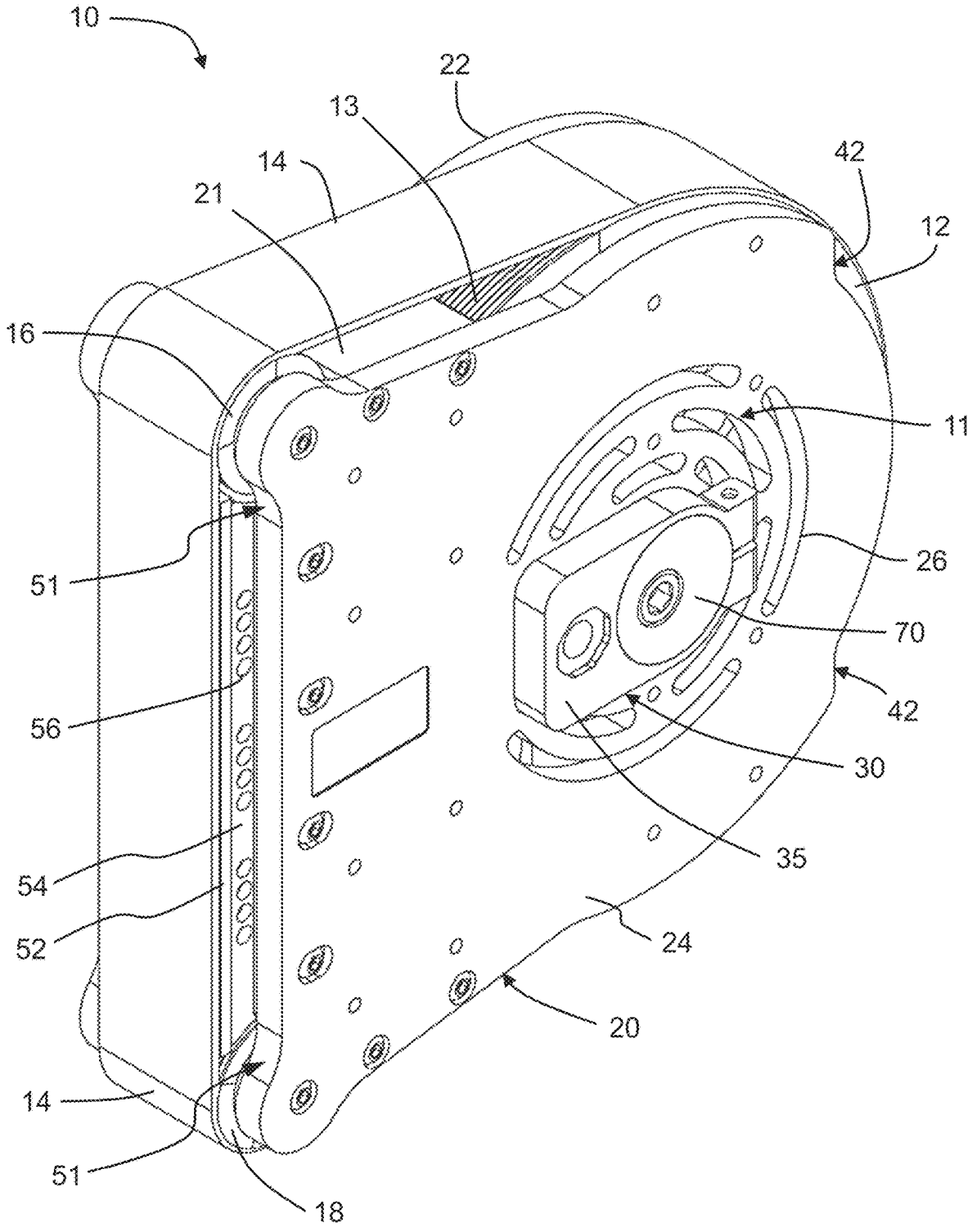
Figure 4:
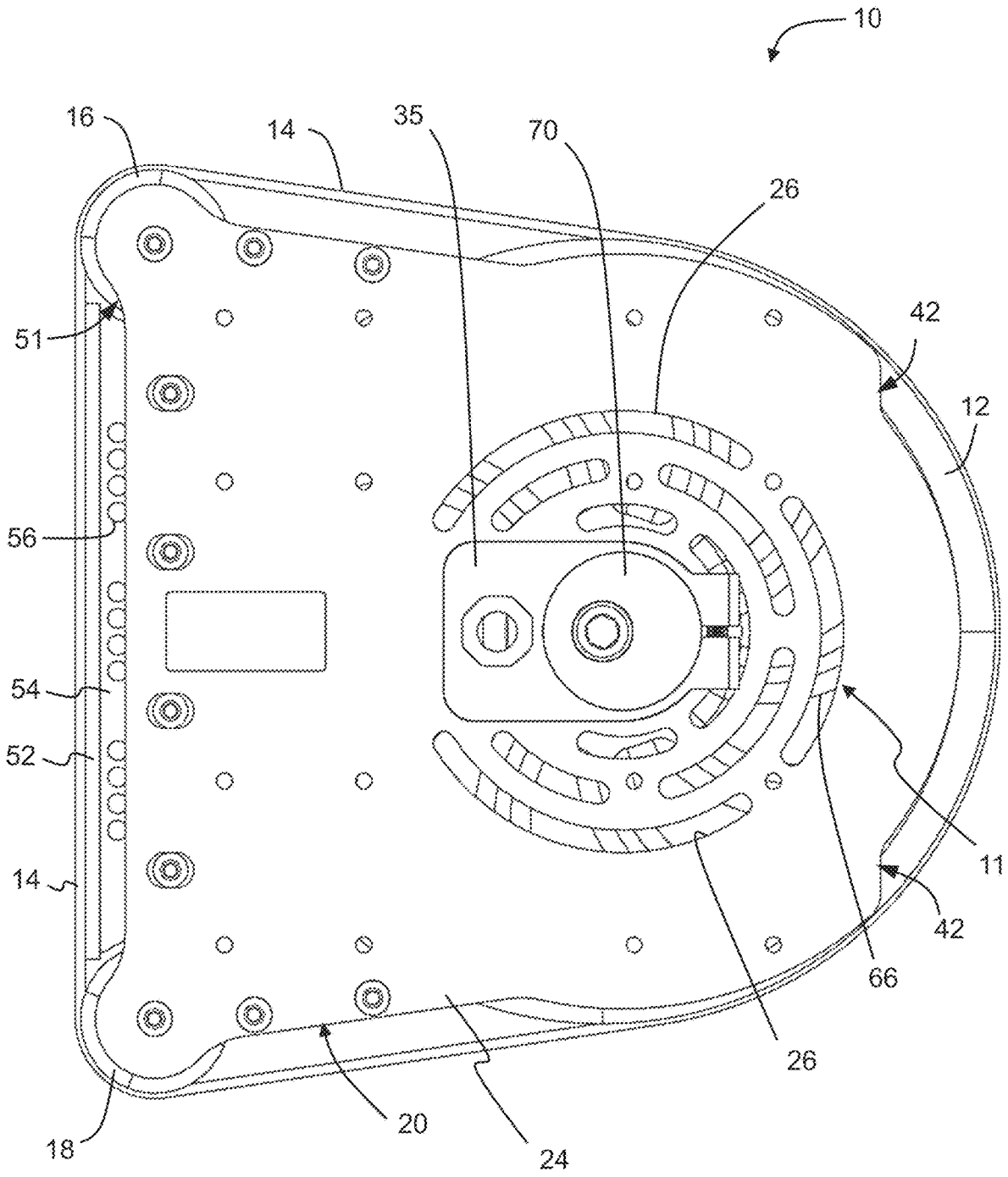
Figure 5:
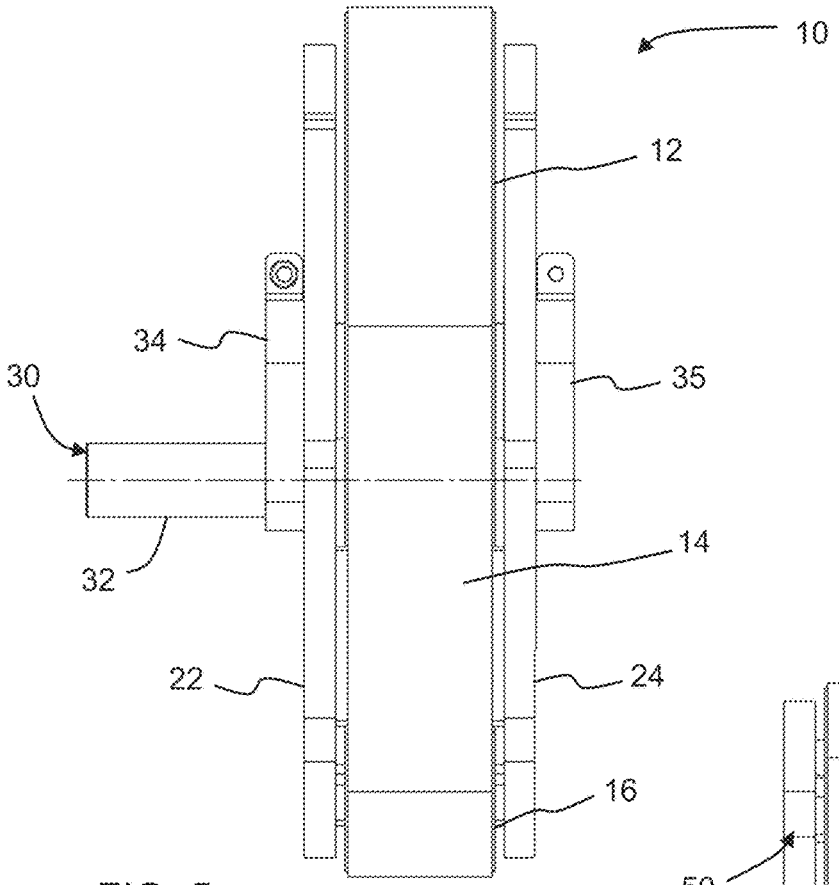
Figure 6:
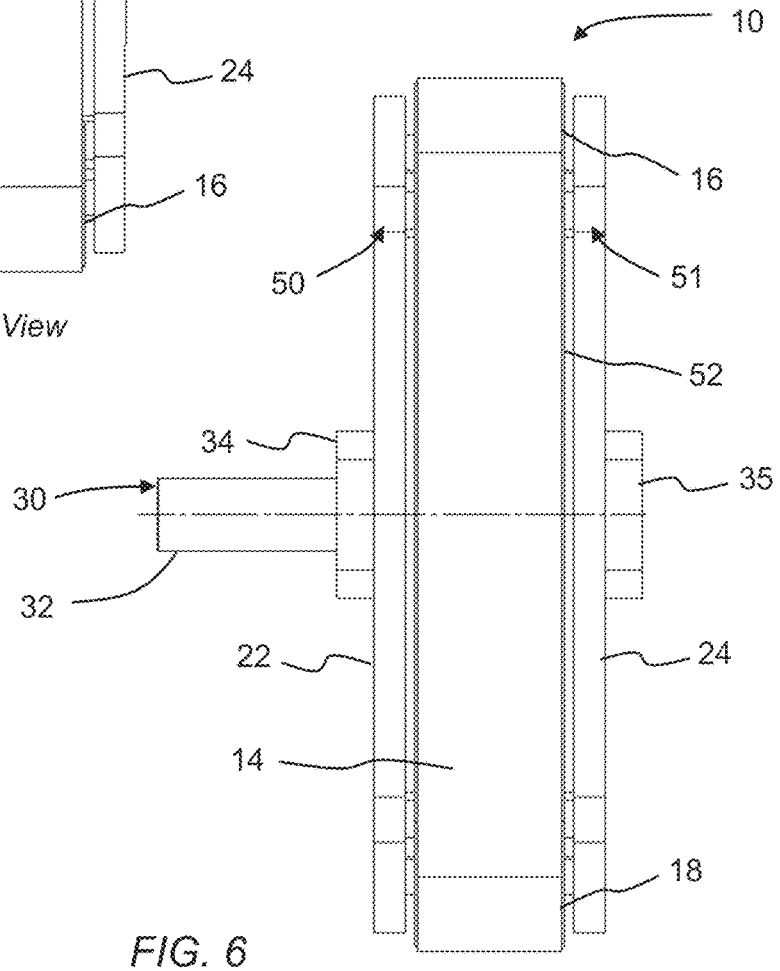

Referring to FIGS. 1-6, it is shown a platen apparatus 10 according to the present teachings. The platen apparatus 10 includes a turbine wheel 12, a housing 20 in which the turbine wheel is positioned, and a heat management system 11. The turbine wheel 12 is rotatably mounted on a bearing system 70 and is made of a lightweight material that has properties to dissipate thermal buildup, for example aluminum. The housing 20 is partially open so that at least a portion of the turbine wheel 12—for example the circumferential edge of the turbine wheel—is exposed to an environment outside the housing 20. In other words, the housing 20 does not establish a complete enclosure around the entire turbine wheel 12. The partially-open configuration of the housing 20 minimizes any build-up of heat that is generated by the turbine wheel and other moving components of the platen apparatus (e.g., belt 14), and in some instances, helps to dissipate heat away from the turbine wheel and other moving components. The housing 20, for example, comprises at least two plates 22 and 24 arranged on opposite sides of the turbine wheel 12. In some embodiments, the plates 22 and 24 are parallel with one another, as shown in FIGS. 5 and 6. In other embodiments, the plates 22 and 24 may be non-parallel and define planes that converge in one direction and diverge in an opposing direction.

The plates 22 and 24 of the housing 20 may be constructed from a metal, such as steel. Alternatively, the plates 22 and 24 may be made of aluminum, which possesses excellent thermal conductivity (better than steel) and low density. The carbide material increases heat flow away from heat-producing components and thus makes it advantageous for thermal management. Each plate 22, 24 has a recessed area 40, 42 in their respective rear ends. The recessed areas 40, 42 thus expose a portion of the turbine wheel 12 to the exterior environment outside the housing 20. Accordingly, the recessed areas 40, 42 help reduce build-up of heat generated by the turbine wheel and other moving components of the platen apparatus (e.g., belt 14).

As shown in FIGS. 1-6, each plate 22, 24 includes at least one vent 26, and preferably a plurality of vents 26, that enable free flow of air through the area defined between the plates, from one side of the housing to the other side of the housing. The one or more vents 26 in each plate 22, 24 thus allow for heat to escape. For protective purposes, the one or more vents 26 may be configured in a narrow array to prevent an operator's fingers from reaching inside the housing and thus keeping the fingers safe from the rotating vanes of the wheel 12, as described further below. The one or more vents 26 may extend or run in a circular direction around a center (rotation axis) of the turbine wheel 12. When there are multiple vents 26, they may be distributed in two or more circular rows, for example three rows as shown in FIGS. 1-4. The vents 26 in a given plate 22, 24 may have different lengths or may all have the same length. Further, vents in different rows may be aligned radially (i.e., along a radius extending outward from the rotation axis of the turbine wheel), staggered, and/or partially overlapping one another. In alternative embodiments, each vent may be linear and extend vertically, horizontally, or diagonally in the plate.

Figure 13B:
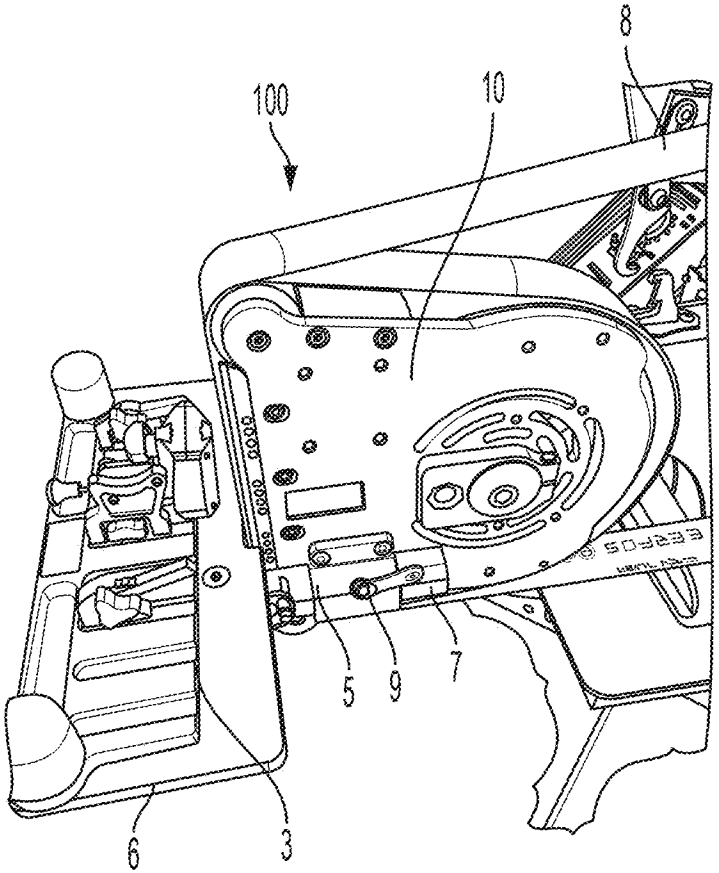
FIGS. 13*a*-13*b* illustrate a grinding tool system comprising the platen apparatus of FIGS. 1-6, a worktable clamped thereon, and a workpiece fixture which can be moved around on top of the worktable and is configured to securely hold a workpiece.
Figure 13A:
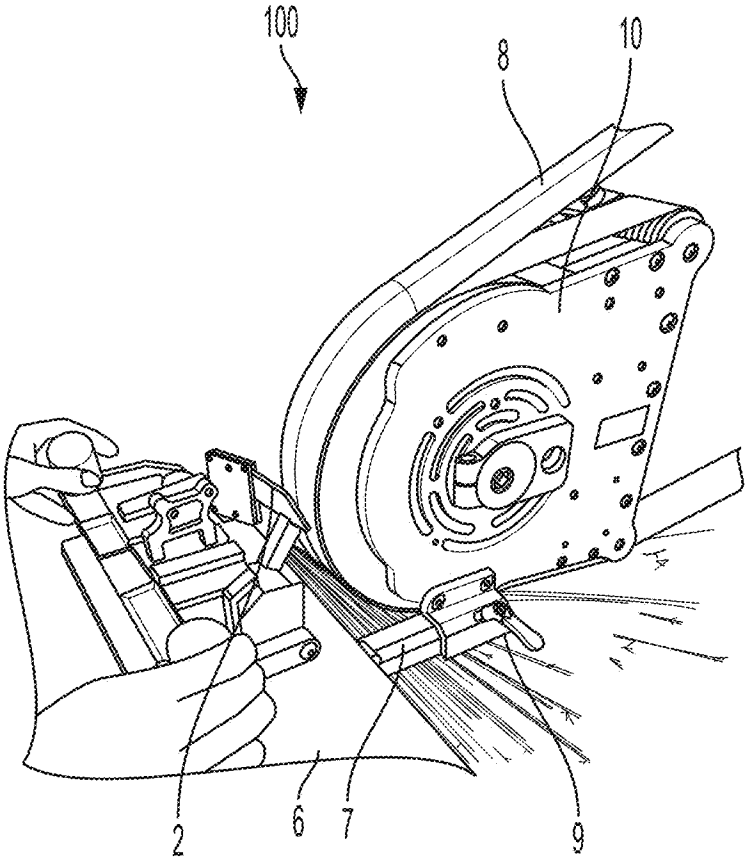

The platen apparatus 10 also includes a support belt 14 and at least two pressure rollers 16, 18. The belt 14 moves around the turbine wheel 12 and the pressure rollers 16, 18 for the purpose of providing support to an abrasive belt 8 of a belt grinder (FIGS. 13*a*-13*b*). The rollers 16 and 18 are rotatably mounted between the plates 22 and 24 and have centers (rotation axes) that are parallel to the center (rotation axis) of the turbine wheel 12. The pressure roller 16 may be aligned vertically or substantially vertically above the pressure roller 18. Also, the pressure rollers 16 and 18 may be positioned so that the turbine wheel 12 is equidistant from both pressure rollers. Alternatively, with the pressure rollers vertically aligned with each other, the turbine wheel 12 may be positioned closer to one of the pressure rollers. As a result, the distance separating the pressure rollers, the distance separating the turbine wheel 12 and the pressure roller 16, and the distance separating the turbine wheel 12 and pressure roller 18 are different, so that each pair configures the belt 14 with a different amount of tension. In other embodiments, the center (rotation axis) of pressure roller 16 may be positioned vertically offset relative to the center (rotation axis) of pressure roller 18, when viewing the platen apparatus from the sides (as in FIGS. 2 and 4). The distance between the rotation axis of the pressure roller 16 and the rotation axis of the turbine wheel 12 therefore differs from the distance between the rotation axis of the pressure roller 18 and the rotation axis of the turbine wheel 12. Accordingly, each pair configures the belt 14 with a different amount of tension. In some embodiments, each pressure roller as a whole is fixed in a stationary manner such that the center of the roller does not move relative to the center of the turbine wheel. Belt tension therefore may only be changed by the turbine wheel. In other embodiments, one or more of the pressure rollers may be adjustable in position (e.g., independent of the others), such that belt tension may be changed by the pressure roller(s). One of the pressure rollers may be configured as a drive roller to drive movement, or assist in driving movement, of the belt 14. The other pressure roller may be configured as an idle roller to stabilize movement of the belt 14.

The turbine wheel 12 may be configured to assist the movement of the belt 14 around itself and the pressure rollers 16, 18. In this regard, the circumferential face of the turbine wheel 12 may include a plurality of grooves or serrations 13. The grooves 13 are typically spaced uniformly from each other and can run straight around the face of the wheel 12 (FIGS. 7-8) or run at an angle (e.g., 30°, 45°, 60°, 90°) across the face. As such, the belt is effectively supported by the "lands" of the wheel face. The underside of the belt 14 may include a plurality of ribs that engage the grooves 13 in complementary fashion. For example, the belt 14 may be a thin rubber micro-v belt (J section approximates ⅛" thick). The pressure rollers 16 and 18 may similarly have a plurality of grooves or serrations on their respective circumferential faces.

In contrast to conventional grinding systems where contact wheels include a rubber coating on their circumferential faces to provide cushioned support to the drive belt, applicant has surprisingly found through experimentation that the turbine wheel 12 without any coating on its face provides thermal management benefits. In particular, the metal material (e.g., aluminum) of the turbine wheel is in direct contact with the belt 14. It has been found that a silicone rubber coating around the turbine wheel acted as an insulator and hampered the beneficial cooling effects of the platen apparatus. Moreover, applicant has discovered that the rubber coating is unnecessary to reduce belt bump caused by the tape joint in the abrasive belt and that cooling is improved in the absence of a silicone rubber coating on the turbine wheel 12. The wheel face having a bare configuration (no rubber coating) exhibits better heat dissipation characteristics and reduces heat buildup within the confines of the housing 20 (i.e., plates 22 and 24), compared to a rubber coated configuration.

Figure 7:
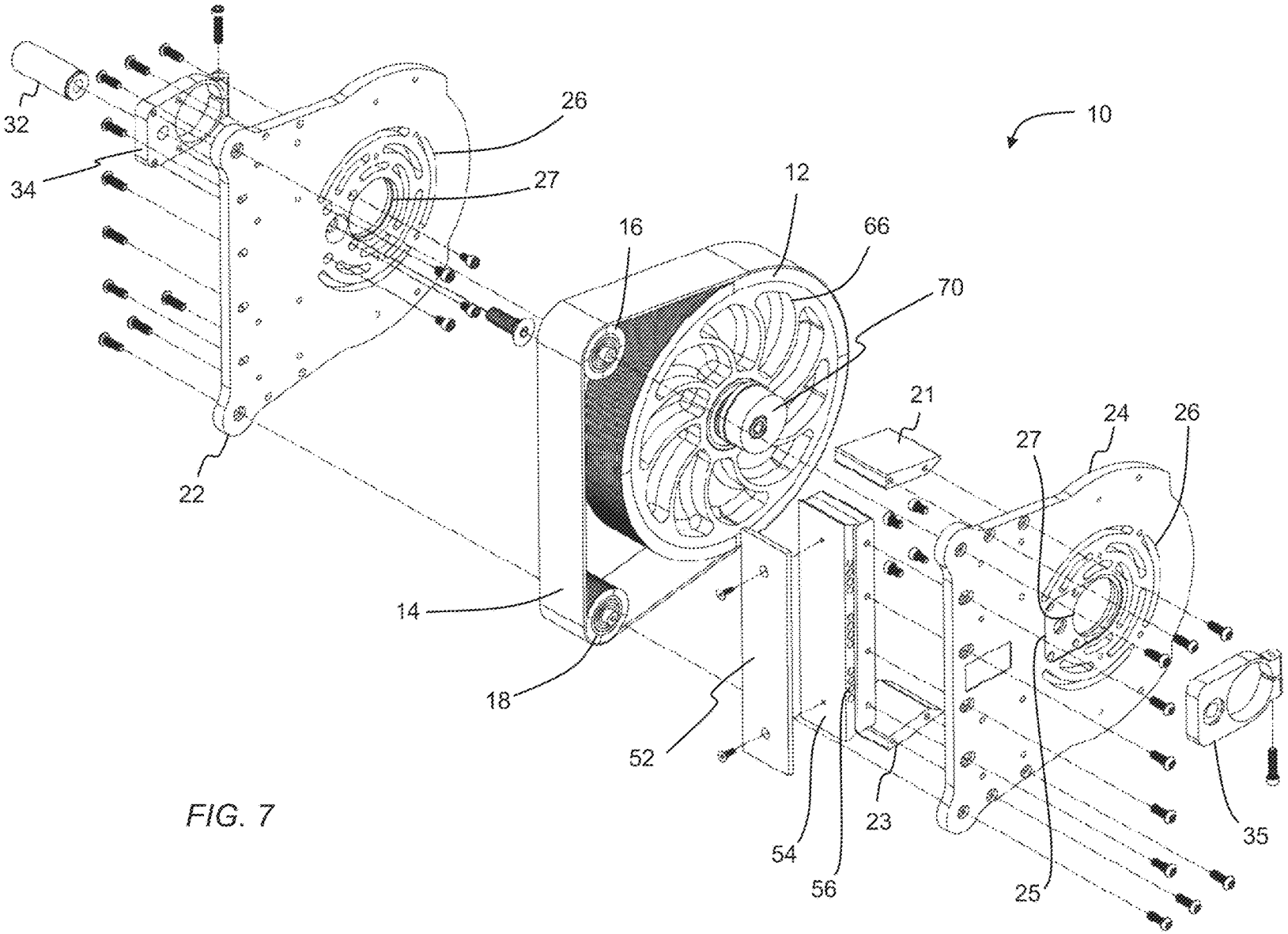
FIG. 7 is an exploded view showing various components of the platen apparatus of FIGS. 1-6, including a turbine contact wheel according to the present teachings.

The platen apparatus 10 comprises a support plate 52 and a heat-sinking saddle 54. The heat-sinking saddle 54 is rigidly fastened between the plates 22 and 24 and is positioned between the pressure rollers 16 and 18. The front end of each plate 22, 24 includes a recess or cutout section 50, 51 as shown in FIGS. 1-4. The recess 50, 51 defines a section of the front end which is indented in a direction towards the rear end. In some embodiments, the recess accounts for at least 50% of the front end of the plate, and for example 50-95% of the front end, 60-90% of the front end, or 70-85% of the front end. The recesses 50, 51 provide space for mounting the heat-sinking saddle 54 and allow a forward portion of the heat-sinking saddle 54 to be exposed beyond the plates 22, 24. The heat-sinking saddle 54 has a substantially rectangular body defined by a front mounting surface, a rear surface facing the turbine wheel 12, and side surfaces fixed to the plates 22, 24. The front and rear surfaces of the heat-sinking saddle 54 are substantially perpendicular to the plates 22, 24. The heating sinking saddle may be made of a material that dissipates heat (e.g., aluminum) or another material that serves the function in a comparable manner. In similar respects, the support plate 52 may be made of steel (e.g., hardened D2 steel), carbide, or a combination of both. Note, the heating sinking saddle and the support plate may or may not be made of the same material. The support plate 52 is releasably fastened to the front surface of the heat-sinking saddle 54, in an area of the recesses 50, 51. For example, several screws are inserted through apertures in the support plate 52 and into threaded holes formed in the heat-sinking saddle 54 to secure the support plate 52 (FIG. 7). This allows the user to easily access the support plate 52 (e.g., for replacing a worn-out support plate with a new one), without disassembling the housing 20. Once the support plate 52 is attached, it is arranged between the belt 14 and the heat-sinking saddle 54. The belt 14 is engaged in tension about the pressure roller 16 and the pressure roller 18, allowing the belt to move around the pressure rollers. The belt 14 is positioned offset from the support plate 52, opposite the heat-sinking saddle 54. That is, there is a small gap between the support plate 52 and the belt 14 when the belt is in the static state. The belt, however, can flex backwards (towards the support plate) when in use. In this way, when a user does not press a piece of blade material against a grinder's abrasive belt 8 towards the support belt 14, the support belt 14 is not in contact with the support plate 52, and the support belt is able to move freely without any friction with the support plate. When a piece of blade material is pressed into the grinder's abrasive belt 8 and in turn into the support belt 14, contact between the support belt and the support plate allows the heat from the support belt 14 to dissipate into the support plate 52 and subsequently through the heat-sinking saddle 54. The heat dissipation at this end of the platen apparatus is achieved via the heat-sinking saddle, which constantly has air driven out through cooling channels 56, as described below.

In some embodiments, the heat-sinking saddle 54 has one or more cooling channels 56, each of which extend all the way through the front portion of the saddle body, from one side surface to the opposing side surface of the heat-sinking saddle 54, as shown in FIGS. 1-4 and 7. The channels 56 provide fluid communication with the external environment and thus allows free flow of air through the heat-sinking saddle 54, thereby promoting release of heat from the heat-sinking saddle 54 to the surrounding environment outside of the housing 20. In addition, the heat-sinking saddle 54 may be in thermal communication with the heat management system 11. For example, the heat-sinking saddle 54 may include at least one heat-dissipating channel which traverses from the rear surface through the saddle body to the front mounting surface. The at least one heat dissipating channel may terminate proximate to the front mounting surface or may include an opening at the front mounting surface. The at least one heat dissipating channel enables heat collected by the saddle body to transfer from the front mounting surface through the saddle body for subsequent dissipation by the heat management system 11.

The platen apparatus 10 also includes a tool mount 30 for securing the platen apparatus 10 to a tool arm or tool bar of the belt grinder via a releasable attachment. The tool mount 30 comprises two brackets 34, 35 which are fixed to the ends of the bearing system 70 and are positioned on the exterior sides of the plates 22, 24. The brackets 34, 35 have a slotted tension configuration that clamps around the eccentric cams on each side of the turbine wheel bearing system 70. The brackets are further fastened (e.g., via a bolt) to the plates 22, 24. In some embodiments, each bracket 34, 35 is clamped onto the bearing system 70, for example by means of a helical-threaded screw fastener or a worm drive/gear fastener. Each plate, as shown in FIG. 7, includes a depression 25 on the exterior side for receiving the bracket 34, 35. The borders of the depression 25 form a shape that matches substantially the shape of the bracket 34, 35, so that the bracket mates with the depression. When the brackets 34, 35 are fitted within the respective depressions 25 and clamped to the bearing system 70, the brackets are stationary relative to the plates 22, 24. Further, the bracket 34 includes a pole extension 32, which is perpendicular relative to the body of the bracket 34, as shown in FIGS. 1-2 and 5-6. The pole extension 32 may be cylindrical or rectangular in shape and is configured to be inserted into a socket of corresponding shape which is formed in the tool arm. In some embodiments, the pole extension 32 is fastened to the bracket 34 via a fastener, such as a screw. In other embodiments the pole extension is an integral part of the bracket 34.

Referring to FIG. 7, an exploded view of the platen apparatus 10 is illustrated. The housing 20 may include an upper plate 21 and a lower plate 23 mounted between the plates 22 and 24. The upper plate 21 and lower plate 23 are substantially perpendicular to the plates 22 and 24. The upper plate 21 is positioned between the pressure roller 16 and the turbine wheel 12, and more specifically, the upper plate 21 is arranged to be above a front section of the turbine wheel 12. Similarly, the lower plate 21 is positioned between the pressure roller 18 and the turbine wheel 12, and more specifically, the lower plate 23 is arranged to be below the front section of the turbine wheel 12. The upper plate 21 and the lower plate 23 do not cover the turbine wheel 12 in its entirety. Besides adding to the structure of the housing, the upper plate 21 and the lower plate 23 help manage airflow, maintaining internal flow moving through the heat-sinking saddle 54 instead of escaping out of the housing (i.e., through the openings if the upper and lower plates are not present). In some embodiments, multiple screws are used to fasten the plates 21-24, heat-sinking saddle 54, pressure rollers 16, 18, turbine wheel 12, and mounting brackets 34, 35 together to form the platen apparatus. In some embodiments, other types of fasteners (e.g., bolts, rivets, clips, clevis, welding, etc.) may be used to connect these components together. Further, a mixture of fasteners may be used to connect these components together.

Figure 9B:
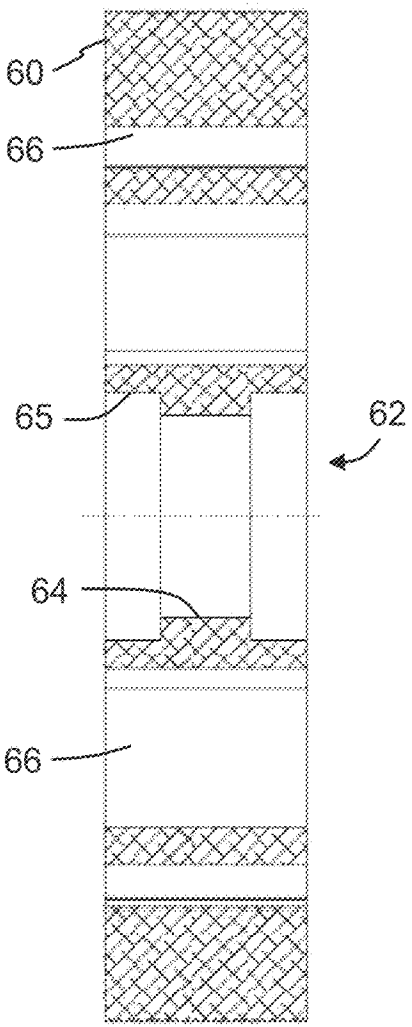
FIGS. 9*a*-9*b* depict a side view and a cross-sectional view of the turbine contact wheel shown in FIG. 7.
Figure 9A:
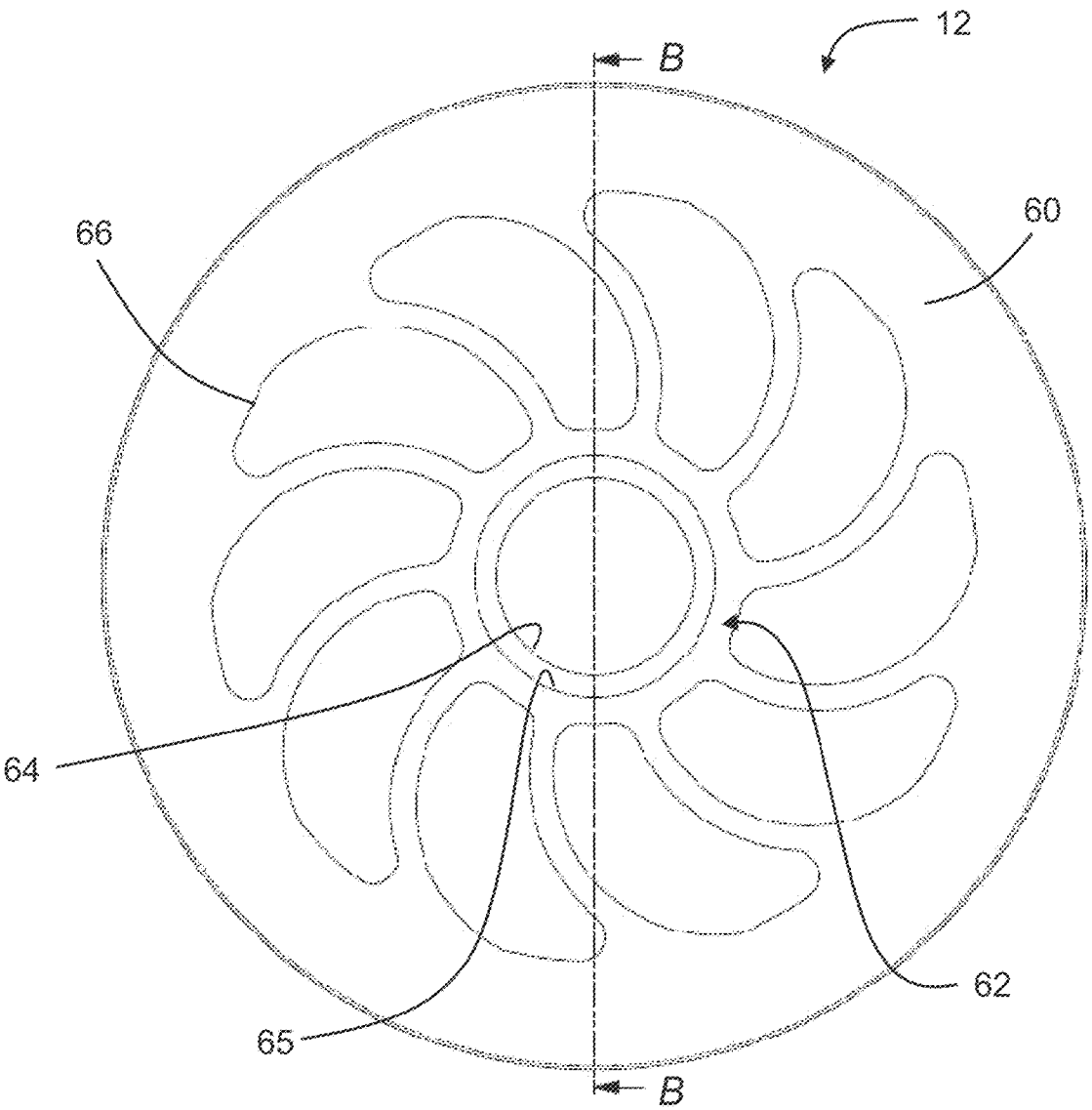
Figure 10B:
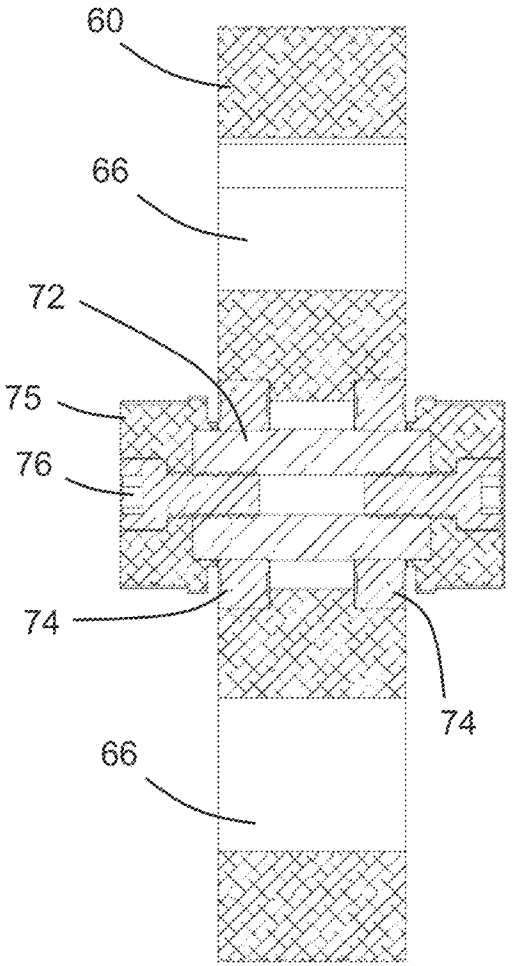
FIGS. 10*a*-10*b* depict a side view and a cross-sectional view of the turbine contact wheel and axle hub shown in FIG. 7.
Figure 10A:
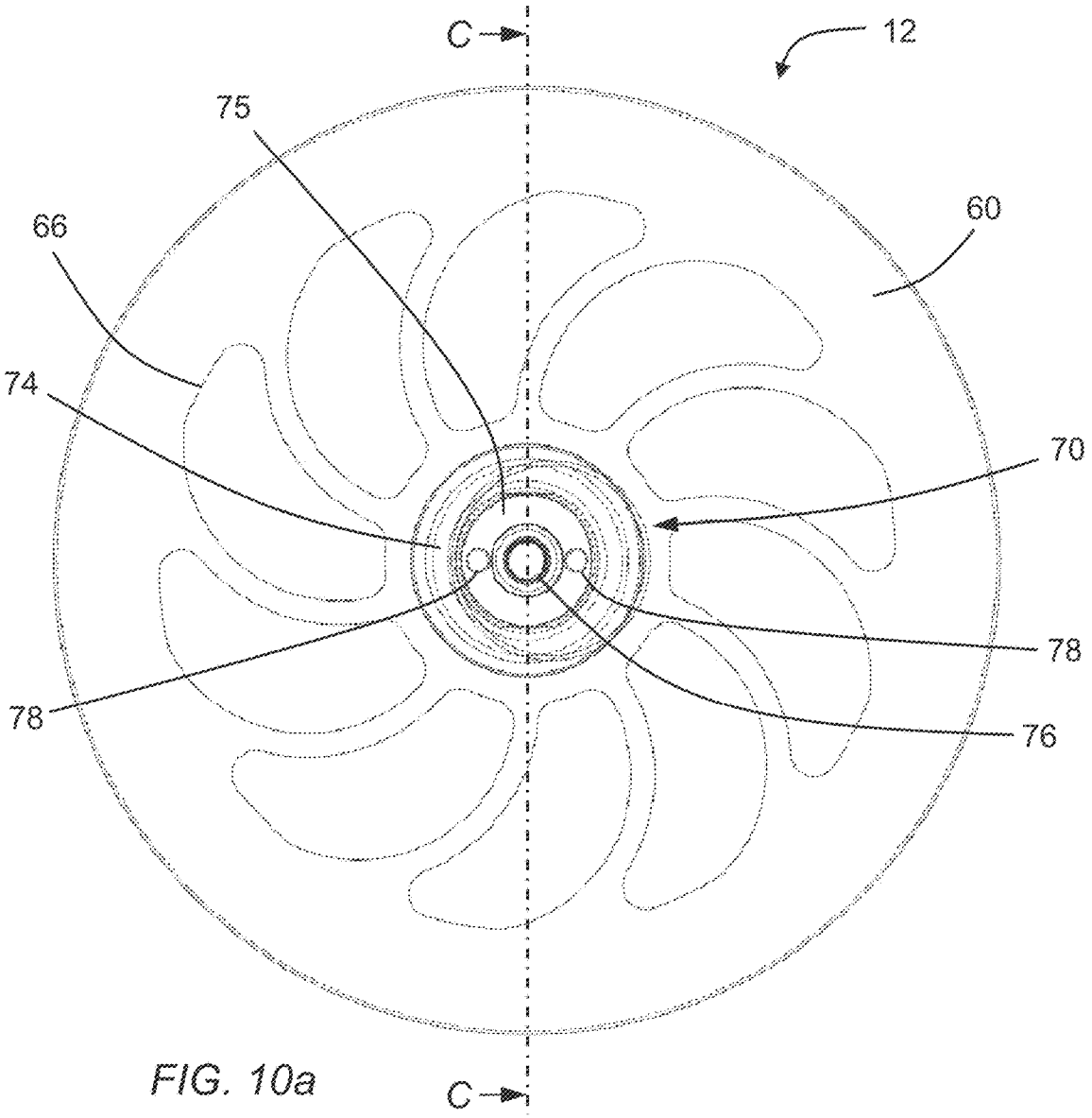

FIG. 7 shows the plates 22, 24 each having the depression 25. Within the depression, there is a hole 27 in the plate. The hole 27 provides access for which the bearing system 70 is inserted through the plate and the turbine wheel 12. Referring to FIGS. **7-10*b*, the turbine wheel includes a center hole 62 through which the bearing system 70 is positioned and rotatably supports the turbine wheel. A set of vanes or blades 66 is cut into and through the body 60 of the turbine wheel 12. That is, each vane is cut into the wheel body in a manner which provides a flow channel through which air is moved from one side of the turbine wheel to the opposing side of the turbine wheel. The vanes 66 are distributed equally around the center hole 62. In particular, each vane 66 spirals outward from the center hole 62 towards the circumference of the turbine wheel 12. The spiral configuration of the vanes 66 promotes efficient air flow through the turbine wheel 12 and further through the housing 20. This also promotes the aerodynamic characteristics of the turbine wheel 12, or at least helps minimize any adverse impact (e.g., rotational drag) on the rotation of the turbine wheel 12 around the bearing system 70. The spiral configuration may also cause less turbulence than non-spiral shaped vanes, which results in less reverberation and less noise therefrom. In some embodiments, the spiral vanes 66 extend through the wheel body in a helical manner. That is, the openings defined by the vanes 66 extend in the form of a helix. As shown in FIGS. 9*a* and 10*a*, the width of each vane 66 increases as it spirals outward from the rotation axis of the turbine wheel. That is, the width of the vane 66** is larger at a location furthest from the center of the turbine wheel than at a location closest to the center.

The turbine wheel (e.g., made of aluminum) functions as a heat sink conducting heat away from the support belt 14. Subsequently, the continuous flow of air through the vanes 66 of the turbine wheel helps to transfer the heat from the turbine wheel to the air, thereby cooling the turbine wheel. The vents 26 in plates 22, 24 overlap in position with the vanes 66. Accordingly, air is drawn through the vents 26 of one plate (e.g., 22), into the vanes 66 from the corresponding side of the turbine wheel 12, passed through the vanes 66 towards the opposing side of the turbine wheel 12, and expelled through the vents 26 of the other plate (e.g., 24). The turbine wheel 12, vanes 66, and vents 26 together establish the heat management system 11. The heat management system 11 keeps the support belt 14—and accordingly the object being worked on (e.g., knife)—cooler while undergoing a grinding or finishing process. The vanes 66 may also be used to push air to/through any adjacent parts of the platen apparatus 10 for similar cooling effect, and for example, the heat-sinking saddle 54 and the support plate 52.

Figure 8:
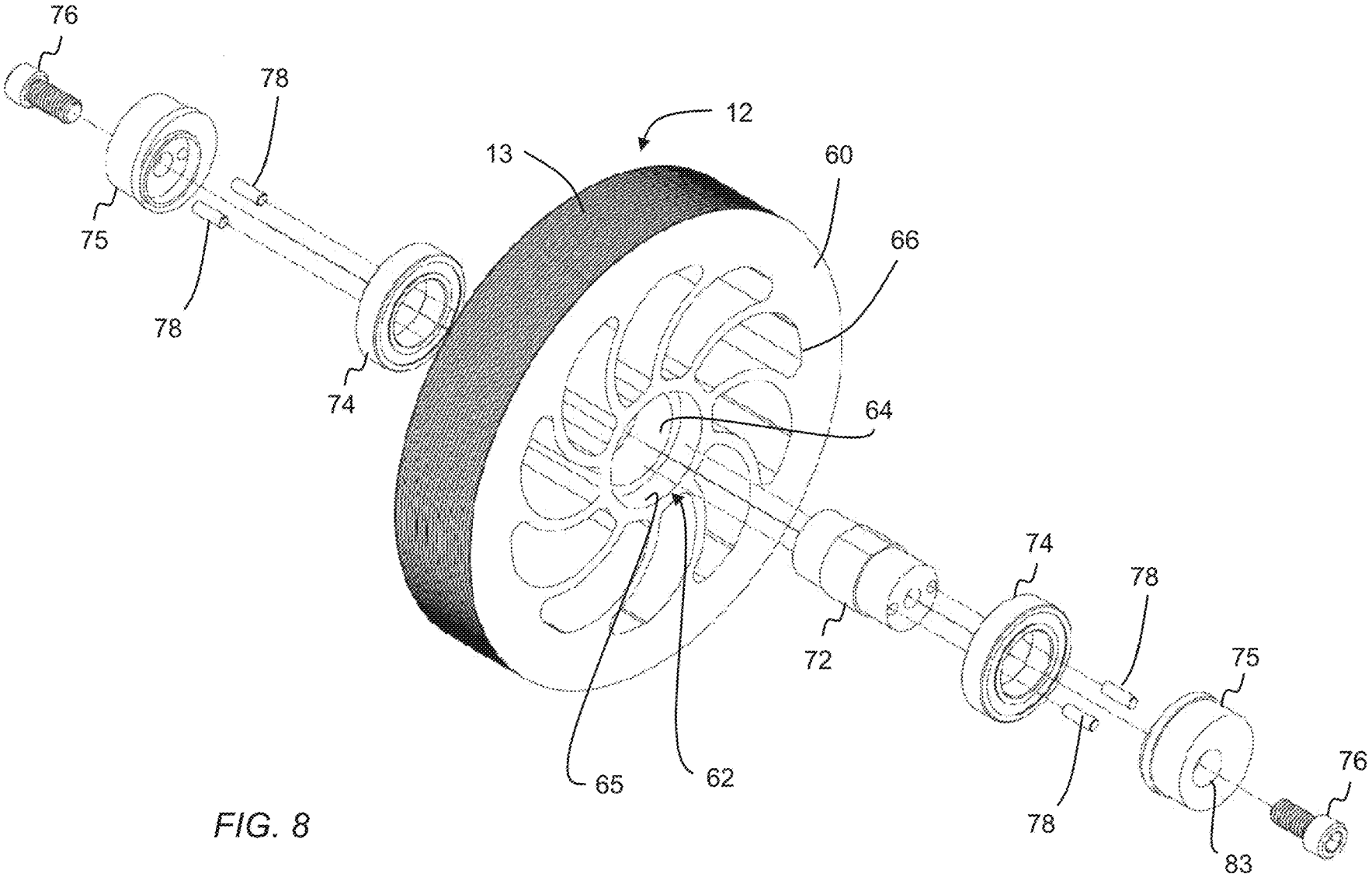
FIG. 8 is an exploded view of the turbine contact wheel and axle hub shown in FIG. 7.
Figure 12A:
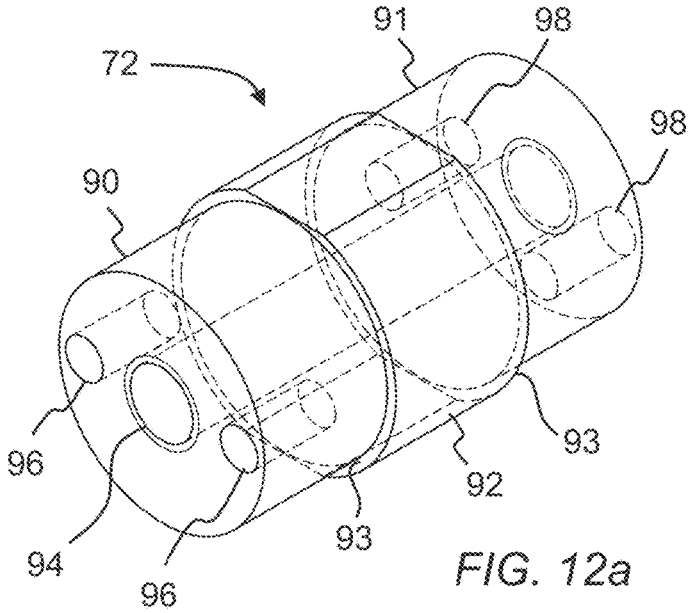
FIGS. 12*a*-12*d* are different views of a shaft of the axle hub shown in FIG. 7.
Figure 12B:
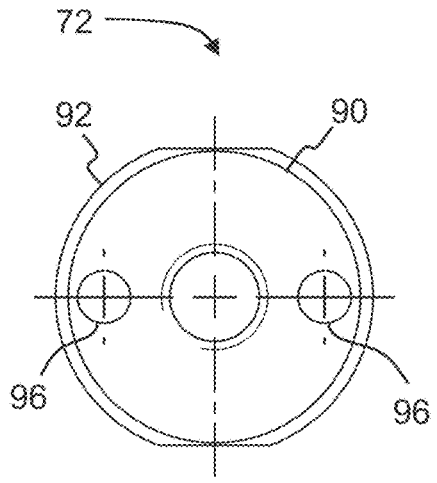
Figure 12C:
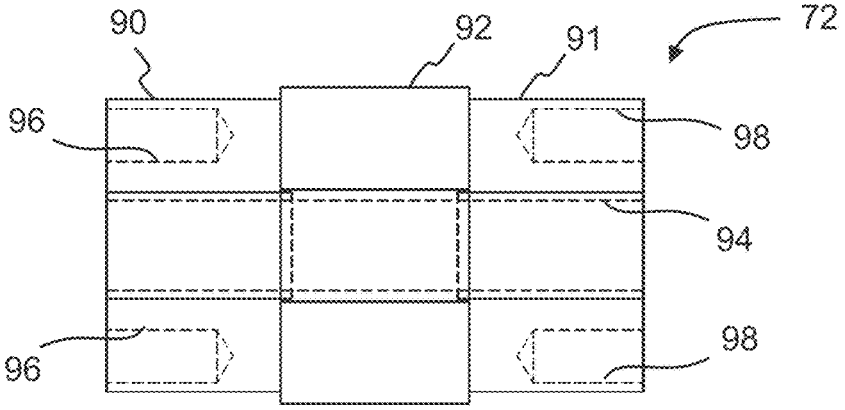
Figure 12D:
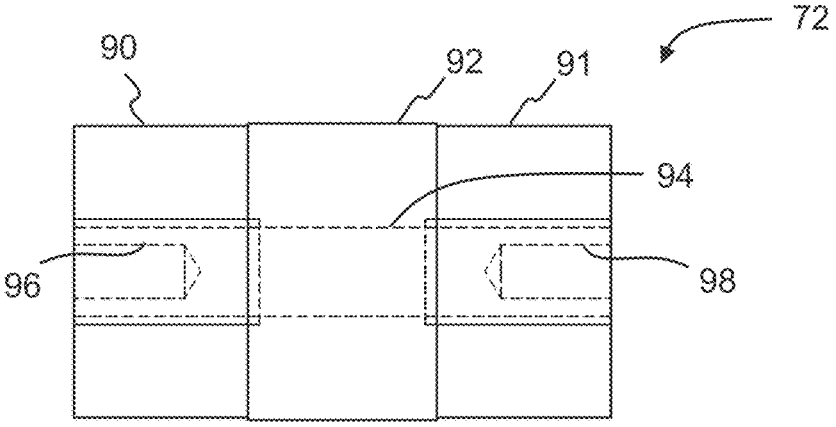

Referring to FIG. 8, the bearing system 70 comprises a shaft or axle 72 positioned through the center hole 62 of the turbine wheel 12. The shaft 72 is defined by three sections, namely a middle section 92 and two end sections 90, 91 on opposite sides of the middle section 92, as shown in FIGS. 12*a*-12*d*. The end sections 90, 91 are cylindrical with a circular cross-section. The shape of the middle section 92 may be characterized as a truncated cylinder, and more specifically, the middle section 92 resembles a cylinder with a truncated curved surface. The curved surface of the middle section 92 is truncated in at least one sector, and for example two sectors on opposite sides of the middle section 92, as shown in FIGS. 12*a*-12*b*. The diameter of the middle section 92 is larger than the diameter of the end sections 90, 91, such that the middle section 92 includes a lip 93. The shaft 72 also includes a cavity 94 that extends between both ends of the shaft along the longitudinal axis of the shaft. The end sections 90, 91 each have a pair of apertures 96, 98 positioned alongside the cavity 94 on opposite sides thereof. The apertures 96 and 98 extend from the respective ends of the shaft 72 towards the middle section 92.

Figure 11A:
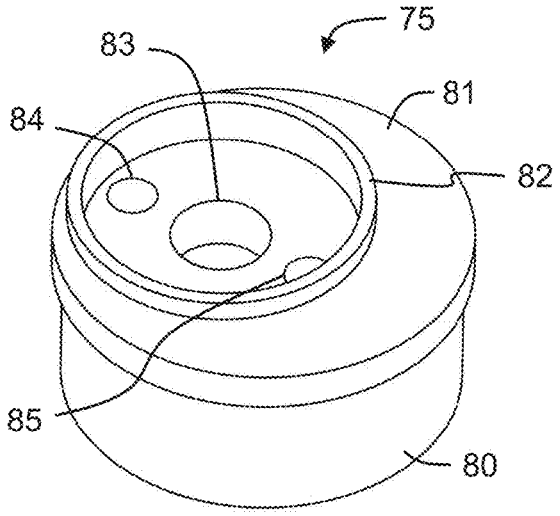
FIGS. 11*a*-11*f* are different views of an end cap of the axle hub shown in FIG. 7.
Figure 11B:
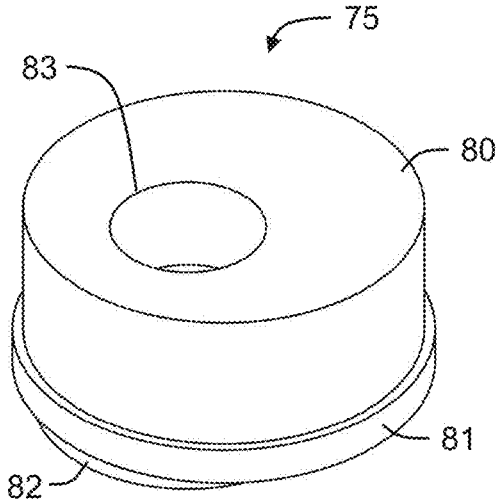
Figure 11C:
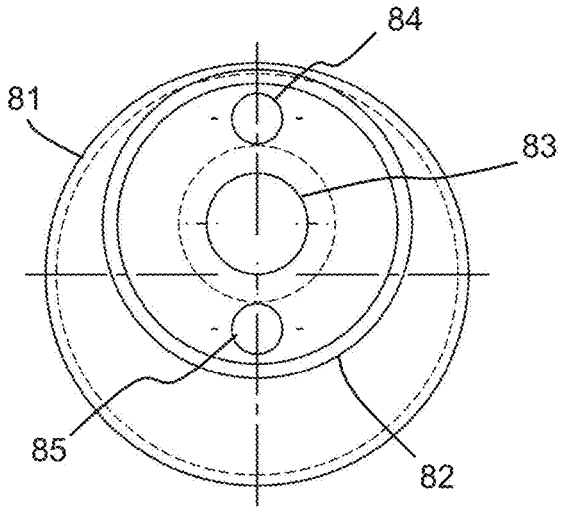
Figure 11D:
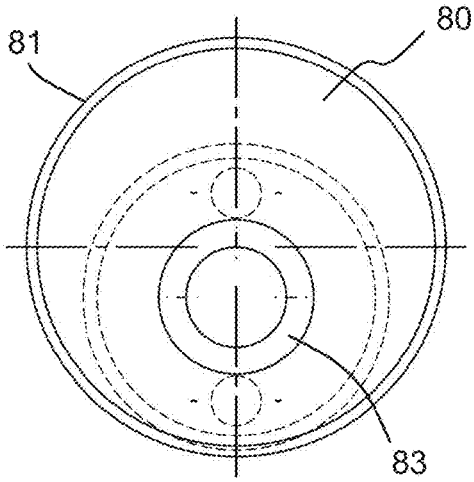
Figure 11E:
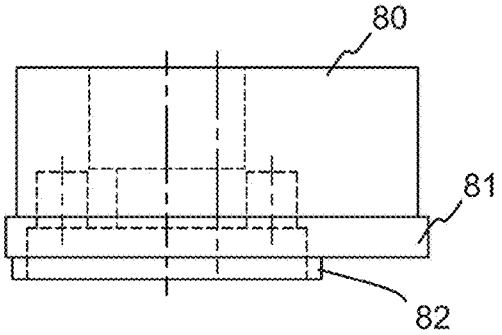
Figure 11F:
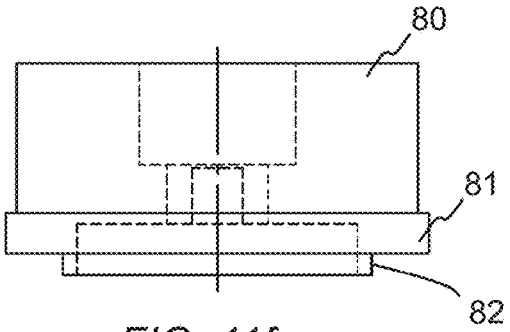

The bearing system 70 further includes two bearings 74 and two end caps 75. Each bearing 74 is mounted around one of the end sections 90, 91 of the shaft 72. The end caps 75 are rigidly fixed to the ends of the end sections 90, 91 to hold the bearings 74 in place around the end sections 90, 91. As shown in FIGS. 11*a*-11*f*, the end cap 75 has a cylindrical body 80 with a rim 81 that extends radially outward beyond the circumference of the cylindrical body 80. In other words, the diameter of the rim 81 is slightly larger than the diameter of the cylindrical body 80. The end cap 75 also has a projection 82 that is substantially perpendicular relative to the planar surface of the body 80. The projection 82 forms a ring shape with a center that is eccentric relative to the center (central axis) of the cylindrical body 80 and rim 81. That is, the projection 82 is not concentric with the cylindrical body 80 and rim 81. A cavity 83 is formed through the cylindrical body 80 and rim 81, extending linearly at the ring center of the projection 82. A pair of apertures 84, 85 are located alongside the cavity 83 on opposite sides thereof. While the cavity 83 extends completely through the cylindrical body 80 and rim 81, the apertures 84, 85 have an opening at the rim 81 and extend completely through the rim 81, but only partially through the cylindrical body 80, as shown in FIGS. 11*e*-11*f*.

To rotatably mount the turbine wheel 12 around the bearing system 70, the shaft 72 is inserted through the center hole 62. The center hole 62 includes a protrusion 64 located at a midpoint between the opposing sides of the turbine wheel 12 (FIG. 9*b*). The protrusion 64 runs along the circumference of the center hole 62, and preferably runs the entire circumference. The protrusion 64 projects radially inward towards the center (rotation axis) of the turbine wheel 12. The raised edges of the protrusion 64 define recessed areas 65 for receiving the bearings 74. Thus, once the shaft 72 is positioned within the center hole 62, the middle section 92 is aligned with the protrusion 64. The bearings 74 are installed around the end sections 90, 91 and received within the recessed areas 65 of the turbine wheel 12. Thereafter, a pair of pins, rods, or the like 78 are inserted into each pair of apertures 96, 98. The end caps 75 are subsequently installed at the ends of the shaft 72 so that they (i.e., projections 82) abut against the bearings 74, thereby holding them in place. To rigidly fix the end caps 75 to the shaft 72, the pins 78 (inserted within the apertures 96, 98) are received within the apertures 84 and 85. In addition, for each end cap 75, a screw 76 is threaded through the cavity 83 of the end cap and into the cavity 94 of the shaft 72 to fasten and secure the end cap (FIG. 10*b*). This mounting configuration results in the longitudinal axis of the shaft 72 (i.e., the cavity 94), the central axis of the bearings 74, the ring center of the projections 82, the longitudinal axis of the cavities 83, and the longitudinal axis of the screws 76 being aligned with the center (rotation axis) of the turbine wheel 12, as shown in FIG. 10*a*. Also, the cylindrical body 80 of each end cap 75 is eccentric relative to the center (rotation axis) of the turbine wheel 12. The eccentric configuration of the end cap 75 provides belt tensioning of the belt 14 and ensures that the belt 14 is kept in tension throughout the movement of the belt 14.

The cooling effect achieved by the heat management system 11, in combination with the support belt 14, allows cutting with extra fine thin abrasive belts 8 without the bump or distortion of cutting typically observed when using a conventional belt grinder/sander. The platen apparatus 10 according to the present teachings also allows less abrasive grits for fine finishing, such as 60 grit to 400 grit to 1000 grit skipping from a less to fine grit with excellent results. Conventional systems on the market are limited to use of more coarse grit abrasive belts because their solid backing and lack of cooling would overheat material and leave streaks from the tape bump.

Referring to FIGS. 13*a*-13*b*, the platen apparatus 10 may include a slot 5 on the exterior side of one of the plates 22, 24. A worktable 6 is mounted to the platen apparatus by sliding a beam or arm 7 into the slot 5. The slot 5 includes a lock 9 for releasably securing the beam 7 in a specified position. When the lock 9 is disengaged, the distance between the worktable and the abrasive belt 8 can be adjusted, or the worktable 6 can be completed removed. The beam 7 is attached to the worktable 6 via a pivot joint, which allows for the orientation of the worktable to be adjusted relative to the beam 7. When the worktable 6 is installed on the housing 20, the worktable 6 can be adjusted to be perpendicular, oblique, or parallel to the support plate 52.

The present teachings also provide a grinding tool system 100, which comprises the platen apparatus 10 and the worktable 6. The grinding tool system 100 further includes a grinding fixture 3 for holding an object 2 (e.g., knife blade) to be worked on with the grinder. The fixture 3 includes clamps that releasably support the object. The clamps can be adjusted to hold the object 2 at different angles, for example between −30 to +30 degrees. The fixture 3 has a plurality (e.g., nine) of dovetail guides along the base to adjust for objects 2 of different sizes/lengths. The fixture 3 may include two adjustable tip standoffs, each of which can be securely fixed into any one of the dovetail guides. The fixture 3 also comprises handle grips that extend vertically up from the base. As shown in FIGS. 13*a*-13*b*, the fixture 3 is placed on top of the worktable 6 and is designed for sliding on the surface of the worktable 6 to achieve a desired grinding/finishing process on the object 2.

While the present teachings have been described above in terms of specific embodiments, it is to be understood that they are not limited to those disclosed embodiments. Many modifications and other embodiments will come to mind to those skilled in the art to which this pertains, and which are intended to be and are covered by both this disclosure and the appended claims. For example, in some instances, one or more features disclosed in connection with one embodiment can be used alone or in combination with one or more features of one or more other embodiments. It is intended that the scope of the present teachings should be determined by proper interpretation and construction of any claims and their legal equivalents, as understood by those of skill in the art relying upon the disclosure in this specification and the attached drawings.

What is claimed is:

1. A platen apparatus, comprising:

a housing having a plurality of vents that provide fluid communication;

a turbine wheel rotatably attached to a rear section of the housing, the turbine wheel having a circular body and a circumferential face without a coating thereon, the circular body includes a plurality of vanes, each vane being a hole which extends through the circular body from one side of the turbine wheel to an opposing side of the turbine wheel;

at least two pressure rollers rotatably attached to a front section of the housing so that rotation axes of the at least two pressure rollers are parallel to a rotation axis of the turbine wheel;

a support belt engaged in tension about the at least two pressure rollers and the circumferential face of the turbine wheel;

the housing only partially enclosing the turbine wheel so that a portion of the circumferential face of the turbine wheel is exposed outside the housing;

the plurality of vanes being arranged adjacent to the plurality of vents and each providing a flow channel through which air is drawn in from a first side of the housing through the circular body of the turbine wheel and released at a second, opposite side of the housing; and wherein each vane spirals outward from the rotation axis of the turbine wheel.

2. The platen apparatus of claim 1, wherein the hole defined by each vane extends through the circular body of the turbine wheel in a helical form.

3. The platen apparatus of claim 1, wherein each vane increases in width as each vane spirals outward from the rotation axis of the turbine wheel.

4. The platen apparatus of claim 1, wherein the housing comprises two plates between which the turbine wheel and the at least two pressure rollers are rotatably attached;

wherein a rear end of each plate includes a recessed area that exposes a portion of the turbine wheel outside the housing.

5. The platen apparatus of claim 4, further comprising a bearing system which connects the turbine wheel to the housing, said bearing system includes:

a shaft extending through a center hole of the turbine wheel;

at least one bearing arranged within the center hole between the shaft and the turbine wheel, the at least one bearing enabling rotation of the turbine wheel relative to the shaft; and two end caps fixed to opposing ends of the shaft and arranged within holes formed in the two plates, the end caps securing the at least one bearing within the center hole;

wherein each end cap has a substantially cylindrical body which is eccentric relative to the shaft.

6. The platen apparatus of claim 5, wherein the at least one bearing comprises two bearings arranged within the center hole between the shaft and the turbine wheel, each end cap securing one of the two bearings in position within the center hole; and wherein the end caps are releasably fixed to the opposing ends of the shaft via fasteners.

7. The platen apparatus of claim 5, further comprising a tool mount which includes:

a first bracket and a second bracket that releasably clamp onto the end caps such that the brackets and the end caps are stationary relative to one another;

wherein the brackets are fixed to the housing; and wherein the first bracket includes a pole that extends perpendicular relative to a body of the first bracket and in a direction away from the housing, the pole being configured to fix the platen apparatus to a bar of a belt grinder or belt sander.

8. The platen apparatus of claim 7, wherein each plate has an exterior side and an interior side opposite the exterior side, the interior side of each plate being adjacent to the turbine wheel and the at least two pressure rollers;

wherein the exterior side of each plate includes a depression that receives one of the first bracket and the second bracket; and wherein the holes formed in the two plates are located within the depressions.

9. The platen apparatus of claim 8, wherein the depression formed in each plate has a shape that matches a shape of a portion of each bracket, so that the brackets mate with the depressions.

10. The platen apparatus of claim 1, further comprising a heat-sink saddle fastened to the front section of the housing between the at least two pressure rollers, the heat-sink saddle having a body defined by a front surface, a rear surface facing the turbine wheel and side surfaces that are fixed to the housing;

wherein the heat-sink saddle includes one or more channels that extend through a front portion of the heat-sink saddle from one side surface to another side surface, the one or more channels providing fluid communication with an environment outside the housing.

11. The platen apparatus of claim 10, further comprising a support plate releasably fastened to the front surface of the heat-sink saddle, wherein the support plate is configured to dissipate heat from the support belt to the heat-sink saddle.

12. A platen apparatus, comprising:

a housing which includes two plates arranged parallel to each other, each plate having a plurality of vents that provide fluid communication;

a turbine wheel rotatably attached to a rear section of the housing between the two plates, the turbine wheel having a circular body and a circumferential face without a coating thereon, the circular body includes a plurality of spiral vanes, each vane being a hole which extends through the circular body from one side of the turbine wheel to an opposing side of the turbine wheel;

a support belt engaged in tension about the circumferential face of the turbine wheel;

the rear section of the housing is at least partially open so that a portion of the circumferential face of the turbine wheel is exposed outside the housing; and the plurality of spiral vanes being arranged adjacent to the plurality of vents of each plate and each providing a flow channel through which air is drawn in from a first side of the housing through the circular body of the turbine wheel and released at a second, opposite side of the housing.

13. The platen apparatus of claim 12, wherein a rear end of each plate includes a recessed area that exposes a portion of the turbine wheel outside the housing.

14. The platen apparatus of claim 12, further comprising a bearing system which connects the turbine wheel to the housing, said bearing system includes:

a shaft extending through a center hole of the turbine wheel;

two bearings arranged within the center hole between the shaft and the turbine wheel, the two bearings enabling rotation of the turbine wheel relative to the shaft; and two end caps fixed to opposing ends of the shaft and arranged within holes formed in the two plates, the end caps securing the two bearings within the center hole;

wherein each end cap has a substantially cylindrical body which is eccentric relative to the shaft.

15. The platen apparatus of claim 14, wherein each end cap comprises a projection that extends out from a planar surface of the cylindrical body and abuts one of the two bearings.

16. The platen apparatus of claim 15, wherein the projection forms a ring shape which is eccentric relative to the cylindrical body and concentric with the two bearings and the shaft.

17. The platen apparatus of claim 16, wherein for each end cap, a cavity is formed at a center of the ring shape of the projection, the cavity extending through the cylindrical body from the planar surface to an opposing planar surface, and wherein the cavity receives a fastener for releasably connecting the end cap to one of the opposing ends of the shaft.

18. The platen apparatus of claim 12, further comprising:

two pressure rollers rotatably attached to a front section of the housing so that rotation axes of the at least two pressure rollers are parallel to a rotation axis of the turbine wheel;

a heat-sink saddle fastened to the front section of the housing between the at least two pressure rollers, the heat-sink saddle having a body defined by a front surface, a rear surface facing the turbine wheel and side surfaces that are fixed to the two plates;

wherein the heat-sink saddle includes a plurality of channels that extend through a front portion of the heat-sink saddle from one side surface to another side surface, the plurality of channels providing fluid communication with an environment outside the housing.

19. A grinding tool system, comprising:

a platen apparatus, which includes:

a housing which includes two plates arranged parallel to each other, each plate having a plurality of vents that provide fluid communication;

a turbine wheel rotatably attached to a rear section of the housing between the two plates, the turbine wheel having a circular body and a circumferential face without a coating thereon, the circular body includes a plurality of spiral vanes, each vane being a hole which extends through the circular body from one side of the turbine wheel to an opposing side of the turbine wheel;

a support belt engaged in tension about the circumferential face of the turbine wheel;

a slot positioned on an exterior side of one of the two plates;

the rear section of the housing is at least partially open so that a portion of the circumferential face of the turbine wheel is exposed outside the housing; and the plurality of spiral vanes being arranged adjacent to the plurality of vents of each plate and each providing a flow channel through which air is drawn in from a first side of the housing through the circular body of the turbine wheel and released at a second, opposite side of the housing, and a worktable having an arm, which is releasably mounted within the slot, the arm being pivotable relative to the worktable to adjust an angle between the worktable and the support belt.

* * * * *